US006245153B1

(12) United States Patent
Gonzales

(10) Patent No.: US 6,245,153 B1
(45) Date of Patent: Jun. 12, 2001

(54) METHOD FOR PRODUCING SUGAR CANE JUICE

(75) Inventor: Jorge E. Gonzales, Coral Gables, FL (US)

(73) Assignee: Hoy Products, Inc., Miami, FL (US)

( * ) Notice: Subject to any disclaimer, the term of this patent is extended or adjusted under 35 U.S.C. 154(b) by 0 days.

(21) Appl. No.: 09/385,240

(22) Filed: Aug. 28, 1999

(51) Int. Cl.[7] ..... C13D 1/02

(52) U.S. Cl. ..... 127/55; 127/30; 127/46.1; 127/57; 210/335; 426/590; 426/599; 426/658

(58) Field of Search ..... 127/30, 46.1, 55, 127/57; 210/335; 426/590, 599, 658

(56) References Cited

U.S. PATENT DOCUMENTS

| | | | |
|---|---|---|---|
| 3,207,628 | | 9/1965 | Rietz et al. . |
| 3,215,559 | | 11/1965 | Lippe et al. . |
| 3,244,560 | | 4/1966 | Diaz Compain . |
| 3,248,262 | | 4/1966 | Appel . |
| 3,275,472 | | 9/1966 | Tantawi et al. . |
| 3,279,357 | | 10/1966 | Farmer . |
| 3,313,653 | | 4/1967 | Jung . |
| 3,355,260 | | 11/1967 | Bruniche-Olsen . |
| 3,425,869 | | 2/1969 | Farmer . |
| 3,432,344 | | 3/1969 | Farmer . |
| 3,553,012 | | 1/1971 | Zievers et al. . |
| 3,553,013 | | 1/1971 | Diaz-Compain . |
| 3,554,799 | | 1/1971 | Diaz-Compain . |
| 3,661,082 | | 5/1972 | French et al. . |
| 3,731,613 | | 5/1973 | Wolff et al. . |
| 3,808,050 | * | 4/1974 | Paley ..... 127/55 |
| 3,874,925 | | 4/1975 | Loncin . |
| 3,969,802 | | 7/1976 | Bouvet . |
| 4,043,832 | | 8/1977 | Leibig et al. . |
| 4,063,960 | | 12/1977 | Paley . |
| 4,151,004 | | 4/1979 | Vukelic . |
| 4,231,136 | | 11/1980 | Villavicencio . |
| 4,378,253 | | 3/1983 | Bouvet . |
| 4,561,156 | | 12/1985 | Sun . |
| 4,636,263 | | 1/1987 | Cundiff . |
| 4,743,307 | | 5/1988 | Mason . |
| 4,765,550 | | 8/1988 | Chen . |
| 4,804,418 | | 2/1989 | Gautier . |
| 4,816,075 | | 3/1989 | Gruenewald . |

(List continued on next page.)

FOREIGN PATENT DOCUMENTS

| | | |
|---|---|---|
| 2 113 247 | 8/1983 | (GB) . |
| 2113247 | 8/1983 | (GB) . |
| 9 604 157 | 6/1998 | (ZA) . |

OTHER PUBLICATIONS

Lakos Industrial/Process/HVAC, no date provided.
Micropure Filtration, no date provided.
Pall Corporation, Solutions For Soft Drink Manufacturers, no date provided.
Schenk Filtersysteme Schenk Primus II, no date provided.
Kampen, Willem H., Dr., Audoubon Sugar Institute, Louisiana State Univ., Improved Clarification With a Cationic Flocculent, no date provided.
Chen, James C.P. & Rauh, James S. Technical and Economic Justification for the Use of Sugar Process Chemicals, no date provided.

*Primary Examiner*—David Brunsman
(74) *Attorney, Agent, or Firm*—Abelman, Frayne & Schwab

(57) ABSTRACT

A method is provided for extracting and processing sugar cane juice from sugar cane sticks to produce a natural juice product. The method includes the steps of: providing sugar cane sticks having a high sucrose level; extracting sugar cane juice from the sugar cane sticks using a roller mill apparatus; filtering the extracted sugar cane juice through a screen filter; stabilizing the pH of the juice in a non-acidic solution of calcium hydroxide; flocculating the sugar cane juice with a mixture of water and at least one natural flocculate product; evaporating the sugar cane juice to form a sugar cane juice concentrate and extracting the sugar cane juice concentrate from the evaporator.

18 Claims, 2 Drawing Sheets

U.S. PATENT DOCUMENTS

| | | | |
|---|---|---|---|
| 4,989,305 | 2/1991 | Pole et al. . | |
| 5,073,200 | 12/1991 | Leibig . | |
| 5,096,499 | 3/1992 | Tilby . | |
| 5,114,490 | 5/1992 | Tilby . | |
| 5,116,422 | 5/1992 | Tilby . | |
| 5,118,353 | 6/1992 | Tilby . | |
| 5,173,122 | 12/1992 | Tilby et al. . | |
| 5,232,510 | 8/1993 | Tilby . | |
| 5,266,161 | 11/1993 | Kroeker . | |
| 5,281,279 * | 1/1994 | Gil et al. | 127/46.1 |
| 5,320,035 | 6/1994 | Sanchez et al. . | |
| 5,358,571 | 10/1994 | Villavicencio . | |
| 5,374,316 | 12/1994 | Tilby . | |
| 5,772,775 | 6/1998 | Riviere . | |
| 5,855,168 | 1/1999 | Nikam . | |
| 6,068,869 | 5/2000 | Ginslov | 426/262 |

* cited by examiner

METHOD FOR PRODUCING SUGAR CANE JUICE

FIELD OF THE INVENTION

This invention relates generally to sugar cane processing, and more particularly to a method for extracting and processing sugar cane juice for the production of a potable natural sugar cane juice product.

BACKGROUND OF THE INVENTION

The production of crystallized sugar from raw sugar cane is well known. Furthermore, the development of equipment and associated processes for producing sugar from sugar cane stalks has been extensive. Generally, sugar product is produced from a naturally-occurring liquid contained within the cells of sugar cane stalks.

In many places throughout the world, and especially in Latin America, this naturally occurring juice contained in the cells of sugar cane stalks is highly regarded as a beverage. In Latin America, this natural juice product is commonly referred to as "guarapo." The term "guarapo", which carries the unmistakable sonority of its Quechuan origin, has become part of the Spanish language to identify and define what is arguably the most pleasant and truly popular beverage in South America. Fresh guarapo has long been regarded as a healthy beverage which, in addition to providing thirst-quenching refreshment, is believed to have attributes that improve and enhance sexual performance. In fact, songs written by grateful Latin Americans having firsthand knowledge of its gifts have become an integral part of Latin American folklore.

Unfortunately, the shelf life of pure guarapo extracted from sugar cane using known methods is very limited, and a process for producing a natural guarapo product for commercial distribution does not exist. As a result, alternative efforts have focused primarily on providing portable equipment geared toward producing guarapo for immediate consumption. For instance, U.S. Pat. No. 5,320,035 to Sanchez et al. teaches a portable sugar cane juice extractor for use commercially in a setting where juice is squeezed to order for individual consumers, such as at a fair or in a retail store. Consequently, the enjoyment of pure guarapo has been primarily limited to persons living in sugar cane producing regions of the world.

It is known to produce a stabilized sugar juice product having an adequate shelf life for commercial distribution. However, known methods require the addition of unnatural chemical additives, such as acids, during juice processing. The addition of chemical additives is undesirable because it alters the natural flavor of the final juice product. Additionally, known methods have the further disadvantage of tending to be economically inefficient for producing commercial quantities.

Accordingly, there is a recognized need for an economical method of processing sugar cane to produce commercial volumes of guarapo for bottling and distribution, whereby the method prevents the natural fermentation of the juice, preserves its natural color, and preserves its natural taste.

SUMMARY OF THE INVENTION

It is an object of this invention to provide a sugar cane juice extraction process which preserves the natural flavor of the juice.

It is another object of this invention to provide a sugar cane juice extraction process which prevents natural fermentation of the processed juice.

It is another object of this invention to provide a sugar cane juice extraction process which preserves the natural color of the juice.

It is an object of this invention to provide a sugar cane juice extraction process enabling the bottling and long term storage of a sugar cane juice product.

It is another object of this invention to provide an economical sugar cane juice extraction process which is adapted for producing large volumes of juice product for commercial distribution.

It is another object of this invention to provide a sugar cane juice extraction process for producing a natural tasting sugar cane juice concentrate which can be added to existing sugar-containing juice drinks without altering the original taste of the drink.

These and other objects are achieved by the method of the present invention. Initially, sugar cane juice is extracted from manually harvested high sucrose content sugar cane sticks using a roller mill tandem. Juice extracted from the first two mills is filtered and then stabilized at a pH of about 7.5 through the addition of Calcium Hydroxide. Subsequently, the juice product is heated from a temperature in the range of about 26.7 to 29.4° C., to a temperature of about 99° C. Subsequently, the juice is subjected to a series of clarification processes in which the additives are preferably limited only to natural products. For instance, it is preferred that natural flocculates are used during the clarification steps. Subsequently, the juice product is concentrated through an evaporation step to form a juice concentrate. Subsequently, the concentrate is further clarified and further concentrated to a Brix of about 75 degrees.

DETAILED DESCRIPTION OF THE PREFERRED EMBODIMENTS

Figure 1:
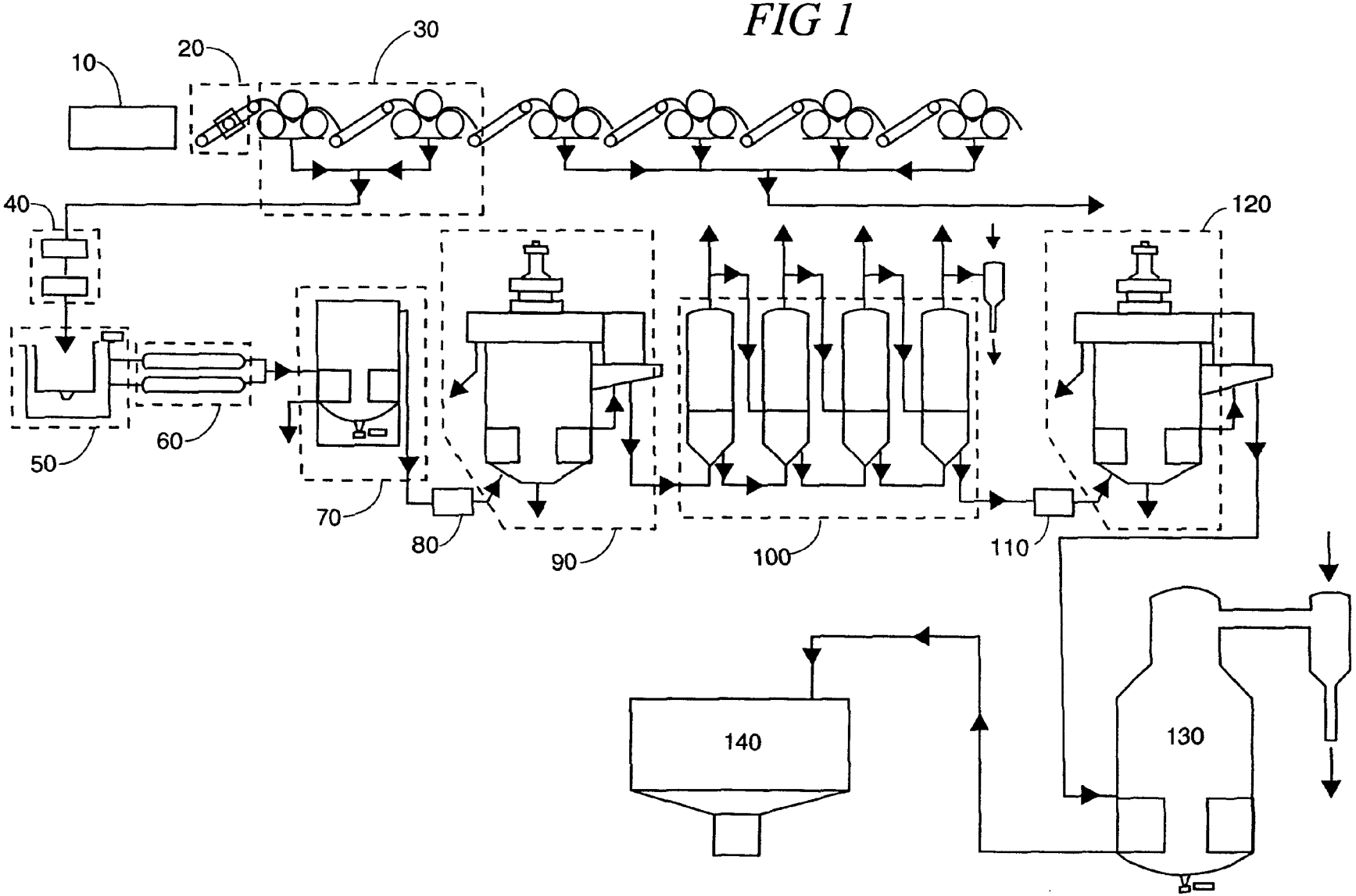
FIG. 1 is a schematic illustration of a method for producing a sugar cane juice product, in accordance with the present invention.

Referring now to FIG. 1, the method of the present invention comprises the following steps:

Sugar Cane Selection

Initially, it is preferable to select extremely sweet, soft and flavorful varieties of sugar cane which have substantially no acidic content. In particular, it is preferred that the raw sugar cane chosen for processing yields a sucrose level of at least 13.7 percent. It will be apparent to those skilled in the art of sugar cane processing, that numerous varieties of sugar cane meeting the preferred standards are available in various regions of the world. Well known examples of sugar cane varieties which work well with the process of the present invention include: CCSP2000 CENICANA COLUMBIA SAO PAOLO; CC8568 CENICANA COLUMBIA; CC8592 CINICANA COLUMBIA; MY74275 MAYAGUEZ; and POJ2878, to name just a few.

Sugar Cane Harvesting & Transport

In the majority of sugar mills around the world, burning the standing sugar cane to facilitate cutting and lifting for transport to the mill is common practice. Where mechanical harvesting is employed and equipment is used for both cutting and lifting, the step of burning is almost always required. Unfortunately, sugar cane burning introduces ash byproduct which alters the natural flavor of the sugar cane juice and cannot be entirely eliminated. Consequently, in the method of the instant invention, it is preferable to avoid the step of burning.

To avoid the need for sugar cane burning, it is preferred that the sugar cane chosen for use with the present invention is manually cut approximately two inches from the stool, removing all green and dry leaves. It is also preferable that the sugar cane tops, commonly referred to as "cogollos," are cut off; thereby avoiding the introduction of their pasty taste which is difficult to eliminate in processing without the use of chemical additives.

Once the sugar cane has been manually cut, it should be manually lifted into a vehicle for transportation to a processing facility. Avoiding mechanical harvesting provides the further benefit of avoiding the introduction of foreign matter commonly carried into the processing mill along with the sugar cane. The foreign matter, often comprising ten percent or more of the sugar cane weight, primarily consists of soil, sludge, ash, leaves, minerals and cane tops. The introduction of the aforementioned foreign matter has the undesirable effect of altering the natural flavor of subsequently extracted sugar cane juice.

Chopping & Juice Extraction

The cut sugar cane stalks are initially transferred onto a conveyer table 10 where they are preferably subjected to a standard washing step to reduce impurities on the surface of the stalks. Subsequently, the sugar cane stalks are conveyed through a standard chopping apparatus 20 to reduce the stalks into smaller individual pieces for feeding through a series of roller mills, as is well known to those skilled in the art.

Although sugar cane juice is extracted at each of the mill sites, in the process of the present invention it is preferred that the juice chosen for subsequent processing in accordance with the present invention is limited to quantities extracted during passage through the first two 30 of the series of mills. The balance of the juice extracted by the remaining mills can be pumped into factory tanks for use with subsequent standard sugar extraction processes.

Many known sugar cane juice extraction methods incorporate hot water maceration to aid in the extraction process. However, in the process of the present invention it is preferable to avoid the addition of hot maceration water to the first two mill sites 30, since hot water tends to dissolve natural waxes and minerals in the hard, outer cortex of the cane stalk. Instead it is preferred that these components are left behind as part of the bagasse.

In addition to avoiding the commonly-used step of maceration, it is preferable to limit the head stock hydraulic pressure in the first two mills to about 1,500 lbs/in$^2$. The limited head stock hydraulic pressure minimizes the undesirable extraction of natural waxes, ferrous compounds and other minerals from the cortex of the sugar cane.

Macro-Particle Filtration

Initially, the sugar cane juice extracted by the first two mills is subjected to a standard filtration process 40 for removing macro-sized particles from the juice product, as is well known in the industry. For the purpose of the present invention, the term macro-sized particle is used to denote particles having an average diameter on the order of at least approximately $10^{-6}$ meters. Preferably, macro-particle filtration is accomplished by passing the juice extracted by the first two mills through a standard steel screen filter having about 300–400 openings/in$^2$, followed by passage through a standard vibrating screen filter having 0.05 mm diameter holes and a vibration frequency of approximately 800 vibrations/minute.

pH Stabilization

Once the macro-sized particles have been substantially removed from the juice, the juice is subjected to a pH stabilization step 50. Precise pH control of the sugar cane juice is critical. The standard procedure in sugar mills is to add Calcium Hydroxide (CaOH), also referred to as milk of lime, until the pH level of the limed juice attains a value in the range of 8.0 to 8.5. With known sugar cane juice processes, the pH level of 8.0 to 8.5 is maintained prior to subjecting the juice to a clarification process, such that the resulting pH level following clarification is about 7.0.

In the method of the present invention, the quantity of Calcium Hydroxide added to the sugar cane juice is limited to an amount required to achieve a pH level of about 7.5. Consequently, the quantity of Calcium Hydroxide additive is reduced relative to the quantity typically introduced using existing processes. This reduction is critical for maintaining the natural flavor of the sugar cane juice. In general, retaining the natural flavor of the sugar cane juice in the final product requires minimizing the quantity of juice additives such as Calcium Hydroxide during processing. Following the subsequently performed steps of heating 60 and clarification 70, the resulting pH level of the sugar cane juice product is maintained at approximately 6.8; optimal for retaining the natural flavor of the juice.

Heating

Following the step of pH stabilization, the juice product is heated 60 from a temperature of approximately 26.7 to 29.4° C., to a temperature of approximately 99° C. Heating is accomplished using a standard heating apparatus as is well known in the industry. For example, one well known type of juice heating apparatus adequate for use with the process of the present invention comprises a vertical or horizontally disposed steel cylinder having plates at opposite ends for supporting juice-communicating tubes therebetween. The flow of juice through the series of tubes is controlled by a series of baffles. Low pressure steam is communicated into the cylinder through a series of mechanical valves and connectors, arranged such that the steam is flowed through a specific path, minimizing the formation of non-condensable gas pockets. The condensate is typically extracted from a lower part of the cylinder via a steam trap.

First (Standard) Clarification

Following the step of heating, the limed juice product is communicated to a standard clarification apparatus 70, as is well known in the industry. Standard clarification includes the addition of any of a number of commonly-used industrial flocculates. For instance, CALGON CANE FLOC R-200 and STORKHAUSEN PRAESTOL are two examples of well known industrial flocculates used for clarification. The flocculates attach to impurities in the limed juice and then descend to the bottom of the clarifying apparatus. With known processes, the flocculates are extracted through standard froth pumps, filtered using a standard filter such as an Oliver filter, and transferred into storage tanks for subsequent use in raw sugar production. However, in the process of the present invention the juice obtained following froth pump filtration requires further purification to retain the natural flavor of the sugar cane juice.

With known extraction processes, a number of non-sugar impurities are retained in the limed juice. The following table illustrates the non-removed impurities present in the limed juice following standard filtration.

TABLE 1

| Impurities requiring additional filtration | (mg/l) |
|---|---|
| Organic non-sugars | |
| Waxy materials (total) | 300–800 |
| Waxy materials; hard sugar cane wax | 20–50 |
| Waxy materials; soft sugar cane wax | 50–100 |
| Waxy material; phosphates | 5–15 |
| Total Proteins | 15–100 |
| Gums | 5–50 |
| Inorganic non-sugars | |
| Cations | |
| CaO | 100–500 |
| MgO | 10–80 |
| $Fe_2O_3$ | 5–30 |
| $Al_2O_3$ | 3–20 |
| Organic Components | |
| Waxy materials | 5–15 |
| Protein non-sugars | 8–15 |
| Pentosans | 3–10 |
| Inorganic Components | |
| CaO | 1–5 |
| MgO | 1–5 |
| $Fe_2O_3/Al_2O_3$ | 3–10 |
| $P_2O_5$ | 1–3 |
| $SiO_2$ | 1–2 |
| Ash insoluble in Hcl (clay & sand) | 5–20 |
| Very fine fiber (bagacillo) | 15–150 |

Second Clarification

In a second clarifying step 90, further clarification is accomplished using a novel clarifying apparatus to remove the majority of remaining non-sugar impurities in the limed juice. The general structure of the novel clarifying apparatus, designed for use with the process of the present invention, is explained in more detail below.

Preferably, natural agricultural flocculate is diluted with water and then added to the juice product in the novel clarifying apparatus. Examples of natural flocculates that can be used include: GUASIMO (GUAZUMA ULMIFOLIA LAMARK); BALSO (OCHOMA LAGOPUS SW); and CADILLO (TRIUMFETTA LAPPULA L).

Prior to being diluted, the natural flocculate is dried and ground into a fine powder. Preferably, the powdered flocculate is diluted with water to form a flocculate compound sufficient for removing remaining impurities in the juice. For example, I have found success mixing 225 grams of any of the above natural flocculates in a tank holding 100 gallons of water. The flocculate mixture is subsequently injected 80 along with the juice into the clarifying apparatus. I have found that 10 grams of flocculate per ton of juice provides adequate flocculation. The use of natural flocculates helps maintain the natural flavor of the sugar cane juice. The flocculate mixture combines with the remaining solids and other impurities suspended in the juice to form a glutinous froth, commonly referred to as Cachaza, which floats to the surface of the juice for easy separation.

Although not preferred, this step of the process can be carried out using any of a variety of commercially-available industrial flocculates, including, but not limited to: Taloflote, manufatured Tate & Lyle, Incorporated; PCS 3106, manufactured by Midland Research Labs; and Quemifloc 900, AH 1000, AP 273, TB 2634, VH 1007, Quemiclar VLC, Quemifloc 724, AH 1010, MPM 1032, and Quemifloc SE, all manufactured by Quemi International, Incorporated. Furthermore, clarification can be carried out using any of a number of available anionic and cationic flocculates.

Figure 2:
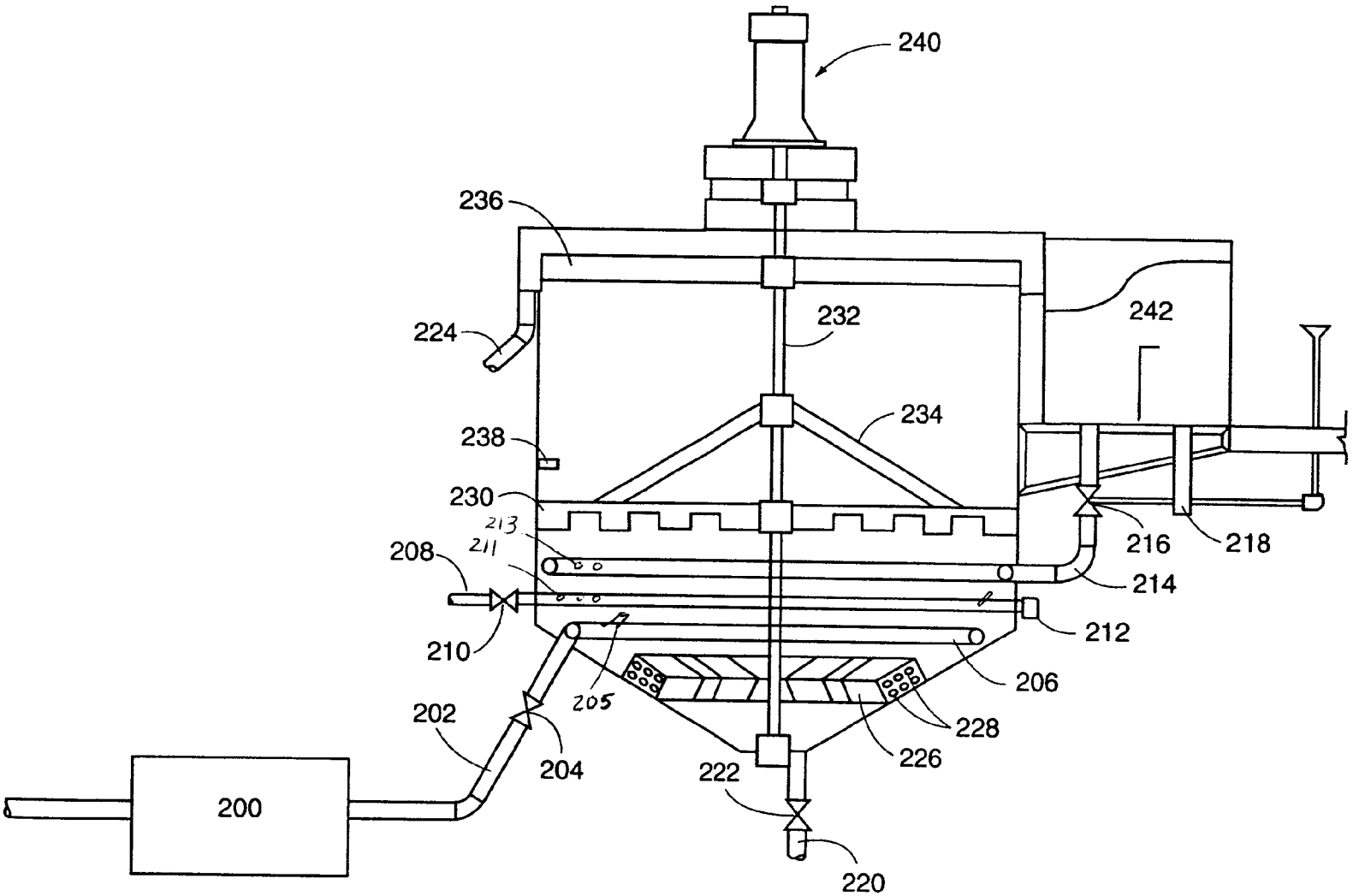
FIG. 2 is a schematic illustration of a sugar cane juice clarifying apparatus for use with method of the present invention.

Referring briefly to FIG. 2, the limed juice and flocculate mixture is injected into the bottom portion of the clarifying tank via conduit 202 controlled by valve 204. Subsequently, the mixture is directed into the tank through conduit extensions 205 an angle of approximately 45 degrees to effect circular rotation of the juice mixture in the tank. The lower section of the tank is provided with a steam coil 226 having a plurality of openings, preferably ⅛ inch in diameter, extending therethrough. The rate at which the steam is released should be just adequate to maintain a juice temperature of approximately 99° C. and provide heat aeration to the juice to affect flocculate formation and flotation to the surface.

A bubble generating apparatus 208 is provided for enhancing the elevation of froth to the surface of the juice. The bubble generator has a vapor inlet 208 and valve 210 for controlling the flow of vapor into the generator. Vapor is released through openings 211 in the generator. A trap 220 is provided at the bottom of the tank for collecting heavy solids that are not carried to the surface. The trap is also used to empty the clarifying apparatus for cleaning.

Upper and lower sets of paddles, 236 and 230 respectively, are rotated at a rate of approximately 0.5 rpm, by motor assembly 240. The lower paddles 230 produce a mild stirring motion which serves to gently stir the juice and effect flocculate formation. An impurity-rich foam froth is formed at the juice surface where it is subsequently skimmed by upper paddles 236 for removal through slurry conduit 224. Preferably, the upper paddles are provided with curved or bowed surfaces to force the froth over the blades. Purified juice product is received through openings 213 in conduit 214 for transport into overfill tank 242. The purified juice is subsequently communicated through conduit 218 for further processing.

Evaporation & Extraction

Following clarification step 90, the juice product is subject to the step of evaporation 100. The juice product is transferred to a standard evaporation apparatus through a transfer conduit. A series of sugar mill evaporators are employed to incrementally increase the sugar cane juice concentration. Preferably the juice concentrate is subsequently extracted from the evaporators at a Brix of 60 degrees. Although a significantly higher Brix is possible, this is the preferred Brix for the additional clarification step 120.

Third Clarification

Preferably, the juice concentrate is subjected to a further clarifying step 120. This step is identical to clarification step 90, with a few exceptions. Namely, the concentration of natural flocculate is reduced by approximately 50 percent. For instance, where natural flocculates are employed the flocculate can be introduced at about 5 grams of flocculate powder per ton of juice. At this step of the process, the juice is preferably maintained at a temperature of approximately 60° C. Following this clarification step, the guarapo juice concentrate is virtually impurity free; having a purity of approximately 99.9 percent.

Vacuum

Following clarification step 120, the concentrate, having a Brix of 60 degrees, is subjected to a vacuum step 120 for further product concentration wherein the Brix is increase to approximately 75 degrees. It will be apparent to those skilled in the art that this step can be performed with a commercially available sugar vacuum pan.

Cooling & Settling

Following vacuum step 130, the sugar cane juice concentrate is pumped into tank 140 for cooling to a temperature below 54.5° C. The tank is provided with a conical bottom fitted with a small trap for solids. Once the sugar cane concentrate having a Brix of 75 degrees is adequately cooled, it can be packed for distribution. The product will remain stable for at least six months, provided it is maintained at a temperature below 24.5° C.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

I claim:

1. A method of producing from raw sugar cane juice a shelf stable sugar cane juice product for human consumption as a beverage or beverage constituent, the product retaining the natural flavor and color of the raw juice, the method comprising the steps of:

providing freshly extracted raw sugar cane juice;

adjusting the pH of the raw sugar cane juice to a pH of about 7.5;

clarifying the pH adjusted, extracted sugar cane juice to remove solid impurities by mixing the sugar can juice with at least one flocculent to form a flocculate with the solid impurities in the fresh juice;

removing the flocculate containing the solid impurities from the juice to produce a juice of a purity of about 99.9%;

pasteurizing the purified sugar cane juice; and recovering and cooling the stabilized purified juice product.

2. A sugar cane juice produced in accordance with the method of claim 1.

3. The method of claim 1 wherein the raw sugar cane juice is extracted from manually harvested sugar cane sticks.

4. A sugar cane juice produced in accordance with the method of claim 3.

5. The method of claim 3, wherein the sugar cane sticks have a sucrose level of at least about 13.7 percent.

6. A sugar cane juice produced in accordance with the method of claim 5.

7. The method of claim 1 wherein the pH is adjusted by addition of calcium hydroxide.

8. A sugar cane juice produced in accordance with the method of claim 7.

9. The method of claim 1 wherein the steps of mixing the sugar cane juice with at least one flocculent and removing the flocculate are repeated.

10. A sugar cane juice produced in accordance with the method of claim 9.

11. The method of claim 1 comprising the further step of concentrating the recovered purified juice to produce a concentrate having a value of about 60° Brix.

12. A sugar cane juice produced in accordance with the method of claim 11.

13. The method of claim 11, wherein the sugar cane juice is extracted by passing said sugar cane sticks through a series of roller mills.

14. A sugar cane juice produced in accordance with the method of claim 13.

15. The method of claim 13, wherein said extracted sugar cane juice is recovered from the first two of said series of roller mills.

16. A sugar cane juice produced in accordance with the method of claim 3.

17. The method of claim 11, wherein the flocculent used in said step of flocculating consists of a natural flocculent selected from the group consisting of Guasimo, Balso, Cadillo, and mixtures thereof.

18. A sugar cane juice produced in accordance with the method of claim 17.

* * * * *